US007802394B1

(12) United States Patent
Bartoli

(10) Patent No.: US 7,802,394 B1
(45) Date of Patent: Sep. 28, 2010

(54) RIFLE BARREL AND METHOD OF DETERMINING RIFLING TWIST FOR VERY LONG RANGE ACCURACY

(76) Inventor: David John Bartoli, 24528 Via Primero, Murrieta, CA (US) 92562-3944

( * ) Notice: Subject to any disclaimer, the term of this patent is extended or adjusted under 35 U.S.C. 154(b) by 523 days.

(21) Appl. No.: 11/899,647

(22) Filed: Sep. 7, 2007

(51) Int. Cl.
*F41A 21/00* (2006.01)

(52) U.S. Cl. ..... 42/78

(58) Field of Classification Search ..... None
See application file for complete search history.

(56) References Cited

U.S. PATENT DOCUMENTS

| | | | | |
|---|---|---|---|---|
| 2,549,832 | A * | 4/1951 | Mackta | 42/78 |
| 2006/0123684 | A1* | 6/2006 | Bunney | 42/60 |
| 2008/0016745 | A1* | 1/2008 | Bunney | 42/6 |

* cited by examiner

*Primary Examiner*—Troy Chambers
*Assistant Examiner*—Samir Abdosh
(74) *Attorney, Agent, or Firm*—Palomar Patent; Calif Tervo

(57) ABSTRACT

A rifle having a rifled barrel and a cartridge having a bullet having a diameter, a length, a ballistic coefficient (BC), and a muzzle velocity ($V_1$) greater than 1250 ft/sec are related to achieve accuracy at very long range in that the twist of the rifling is substantially equal to:

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: $V_2$ is the entry speed for the transonic, i.e. 1,250 ft/sec., and $V_3$ is $V_1$ minus $V_2$. A rifle barrel for receiving a bullet has rifling twist according to the relationship. A method uses the relationship to determine the rifling twist for a rifle barrel receiving a known bullet. Another method uses the relationship to design a cartridge for a known barrel rifling. The relationship is particularly applicable for bullets having a high BC, such as 0.325 or greater.

16 Claims, No Drawings

RIFLE BARREL AND METHOD OF DETERMINING RIFLING TWIST FOR VERY LONG RANGE ACCURACY

FIELD OF THE INVENTION

This invention relates in general to the design of rifle barrels, and more specifically involves a method to determine the correct pitch or twist to achieve accuracy at very long range with modern high ballistic coefficient bullets.

BACKGROUND OF THE INVENTION

In the 1700s, it was discovered that spinning a round lead ball that was being used for a bullet would stabilize the bullet and help keep it on a proper trajectory. It was soon common knowledge that a rifle had about three times the accurate range of a smooth bore musket. When the colonists applied this technology to the battlefield it helped win the Revolutionary War.

During and after the Civil War, cartridge rifles were developed that shot elongated bullets. In 1870 Sir Alfred Greenhill created a formula intended to determine the pitch or twist of the rifling necessary to stabilize an elongated bullet. According to the Greenhill formula, the rifling twist for a given bullet should be 150 times the bullet caliber squared, divided by the bullet length. For example, a 308 caliber bullet having a length of 1.30 inches would have a twist of 150 times 0.308 squared divided by 1.30 which equals 10.95 inches twist or one revolution in every 10.95 inches.

The Greenhill formula worked to stabilize the bullets of his day. Almost all rifled barrels world wide still follow Sir Greenhill's formula. However in 1870, almost all bullets were round nosed or flat pointed round nosed for tubular magazines and had a relatively low ballistic coefficient. The muzzle velocities of these black powder cartridges were much lower than those of the cartridges of today. In general, the Greenhill formula maintains stability for low to medium velocity bullets of low ballistic coefficients throughout their entire trajectory. It will also stabilize modern high velocity supersonic bullets of a high ballistic coefficient in the speed realm only above the speed of sound.

However, for long range shooting, the bullets with a low to medium velocity and low ballistic coefficient have several shortcomings. The slow starting velocity means the maximum range is relatively short. At longer ranges, the bullet drop becomes such that the trajectory must be high, resulting in decreased accuracy. The longer time to target can result in greater wind deflection. Lastly, the velocity/energy remaining at long range may be insufficient to accomplish the intended purpose.

Modern smokeless powder rifle cartridges most often propel bullets of high ballistic coefficients at high supersonic speeds. Most high velocity rifles, rifled according to the Greenhill formula, firing high ballistic coefficient bullets lose accuracy as the bullet slows to slightly faster than of the speed of sound. These bullets tumble or change trajectory as the bullet enters the transonic speed realm. Hence, this determines the effective accurate range of the bullet. Further the Greenhill calculated twist makes no provision for the rotational harmonics of a bullet and therefore rifles made by the Greenhill formula do not have the accuracy potential that is possible.

Heretofore, the standard approach to making a rifle accurate for longer ranges was to increase the distance that the bullet will remain supersonic, so as to impact the target in the supersonic speed range. Consequently, many modern cartridges are made to propel very high ballistic coefficient bullets at very high supersonic speeds. For an example the standard U.S. sniper cartridge (7.62×51 mm M118) has a supersonic range of about 900 yards. To get greater supersonic range, the 338 Lapua Magnum is used and the bullets will stay supersonic and accurate to about 1,800 yards. The 50 caliber Browning machine gun cartridge is used in a 32 pound rifle and has demonstrated accuracy to 2,200 to 2,500 yards depending on the bullet used. The recently developed 416 Barrett was specifically designed to keep the bullet supersonic to beyond 2,500 yards.

Overall, the push to extend the supersonic range of bullets has led to larger rifles using larger cartridges firing at higher breach pressures and bullets of extremely high ballistic coefficients for their calibers. Because of this the shooter has been burdened with physically larger and heavier rifles, heavier ammunition and greater recoil. All this combined greatly limits the mobility of the shooter.

Within the parameters of the strength and weight of a firearm, strength of the shooter, propellants available, bullets used, and recoil developed, there is a physical limit to the range a shoulder fired rifle can shoot a bullet in the supersonic realm.

Therefore, there has been a desire for a rifle having very long range accuracy without extremely high power and velocity.

SUMMARY OF THE INVENTION

This invention provides a method for calculating the necessary rifling pitch or twist for any long range rifle barrel that is intended to shoot an elongated bullet of a high ballistic coefficient in the supersonic realm and have that same bullet maintain the same accurate trajectory through the transonic speed realm and then through the subsonic speed realm until impact.

This invention also indicates the next rotational harmonic node for any given bullet. So if only the supersonic speed realm is desired, the next node may be selected thus giving equal accuracy at a slower twist which will extend barrel life.

From a lifetime of extensive knowledge and empirical study, the inventor deduced that the accurate range of a bullet having a supersonic muzzle velocity likely could be increased by providing the bullet with enough spin so as to result in adequate gyroscopic stability to maintain trajectory during the passage from supersonic flight to subsonic flight through the transonic region. The numerically corrected twist rates would also remediate any imbalance or flaws in the bullet. In putting this into practice, it was soon discovered that the corrected twist rate must be adequate for the passage through the transonic speed realm and balanced to the rotational harmonics node of the bullet at muzzle velocity. Thus the basic idea became to establish the adequate rotational stability to pass through the transonic and then increase that rotation to the correct rotational harmonics node at the muzzle to eliminate most coning, yawing and radians.

According to the invention, for very long range shooting with a bullet having a muzzle velocity greater than 1250 ft/sec, the relationship between barrel twist and a given muzzle velocity and bullet should be: Twist=

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: BC is the ballistic coefficient of the bullet, $V_1$ is the muzzle velocity, $V_2$ is the entry speed for the transonic, i.e. 1,250 ft/sec., and $V_3$ is $V_1$ minus $V_2$.

The mathematical formula consists of four terms. It is solved in three steps. The first term, i.e. 83.7 is the initial modifying number. This factor was established by the test data and provides the formula with the initial rotational speed dependant upon the length/caliber/ballistic coefficient/velocity at 1250 fps in the balance of the formula. The initial factor also contains a portion of the rotational harmonic balance node to be used in combination with the second term of the formula. The first step to the solution of the formula is to divide the initial modifying number by the solution to second term of the formula. The second term, i.e. primarily bullet length divided by the bullet diameter, by itself would, in combination with the first term of the formula, establish the necessary stability for a bullet with a 0.500 ballistic coefficient to penetrate the transonic speed realm. However, the formula is modified to bullet length multiplied by the square root of 2 times the ballistic coefficient divided by bullet diameter. In this form, the twist is corrected, in conjunction with the first term of the formula, to the gyroscopic stability necessary for the ballistics coefficient and the harmonic node of a specific bullet having a specific length and specific ballistic coefficient. At this point the twist is expressed as bullet diameters per rotation. The second step to solution to the formula is to multiply the solution of step one by the bullet diameter. The third term is the quotient of terms one and two multiplied by bullet diameter. This changes the bullet diameters per rotation to inches per rotation. In the third and last step of the solution of the formula, the solution to step 2 is multiplied by solution of term four. The fourth term of the formula, i.e. 1 plus the quantity $V_3$ divided by $V_1$ multiplied by 0.667 corrects the twist to the muzzle velocity for the bullet to arrive at the correct twist at the entry to the transonic at 1250 fps. The fourth term is possible only because of the linear aspect of the relationship between the node and the speed above 1,250 fps. It was found during extensive testing that the rotational harmonics of a supersonic bullet are a variable linear function corresponding to speeds above 1250 fps Once the sections of the formula in the brackets are solved; the formula is solved arithmetically from left to right. It was found during extensive testing and data acquired over 15 years, the rotational harmonics of a supersonic bullet are a variable linear function corresponding to speeds above 1250 fps and the first three terms of the formula. Thus the bullet will leave the muzzle harmonically stable so that it can quickly "settle down" for accurate flight from the muzzle to impact. The ballistics coefficient of the bullet contains hidden aerodynamic, velocity and gyroscopic modifiers which are utilized by the invention.

The inventor is well aware the higher entry to the transonic speed realm begins at about 1,340 fps. 1,250 fps is used in this invention as a reference point only to allow the formula to align with the test data. This empirical formula was developed using the physical interactions between the aerodynamics of the bullet, muzzle velocity, bullet length, bullet diameter, gyroscopic stability potential and ballistics coefficient to determine the correct rifling twist to provide sufficient gyroscopic stability to a bullet throughout the three speed realms and exiting the muzzle within the necessary rotational harmonic node. The next most accurate node suitable only for supersonic flight can be found by multiplying the calculated twist by 1.5.

The standard M24 sniper rifle using the M118 cartridge with the barrel rifling twist cut as indicated by the invention can accurately outrange the 416 Barrett's 2,500 yards. The invention allows accurate shooting at a distance beyond the audible threshold of sound created by the discharge of the M24 rifle. Additionally, the 416 Barrett's range could probably be extended to over 6,000 yards by properly stabilizing its bullet with a correct rifling twist. The exterior ballistics calculations, pertaining to cartridges using a bullet with a high ballistics coefficient, indicate the supersonic range is about 16% of the calculated absolute range. When a portion of the calculated absolute range in the transonic and subsonic can be utilized accurately, the effective range of any modern long range rifle becomes about 45% to 48% of the calculated absolute range. The invention provides the modern sniper rifle with the same quantum leap in accurate range as the Kentucky Rifle demonstrated over the Brown Bess Musket.

Conversely, the method can be used backward to design a bullet or cartridge for a given barrel twist.

Other features and many attendant advantages of the invention will become more apparent upon a reading of the following detailed description.

DETAILED DESCRIPTION OF THE INVENTION

According to the invention, for very long range shooting with a bullet having a muzzle velocity greater than 1250 ft/sec, the relationship between barrel twist and a cartridge having a bullet should be: Twist=

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: BC is the ballistic coefficient of the bullet, $V_1$ is the muzzle velocity, $V_2$ is the entry speed for the transonic, i.e. 1,250 ft/sec., and $V_3$ is $V_1$ minus $V_2$.

The formula calculates the correct pitch or twist for any bullet of a known length, diameter, ballistic coefficient and muzzle velocity, for the most stable and accurate trajectory in the combined supersonic, transonic and subsonic speed realms. The result is an increase in supersonic accuracy and an extension of accurate range up to 300% over conventional barrels.

The ballistic coefficient is a measure of the bullet's ability to overcome air resistance and maintain velocity. The ballistic coefficient is expressed as a ratio in comparison to a standard. The larger the number, the more efficiently the bullet passes through the air. For a given diameter bullet, the higher the ballistics coefficient the more difficult it is to stabilize while passing through the transonic speed realm. The ballistic coefficient is known for a large variety of bullets or may be derived empirically. The higher the ballistic coefficient, the more relevant is the discovered relationship. The formula shows particular improvement for ballistics coefficients greater than 0.325.

According to a first aspect of the invention, the rifling twist for a rifle barrel can be determined for a given bullet by this formula.

The 30/06 is a prime example of the failure of the Greenhill formula. The cartridge started as the 30/03 firing a 220 grain round nosed .308 caliber bullet which has a length of 1.30 inches. It was fired at 2,400 feet per second and rifled with a 1 turn in 10 inches twist. The ballistic coefficient for this bullet is 0.300. The Greenhill formula indicates this bullet will require at least a 10.95 twist. This rifle/bullet/cartridge combination has shown it will shoot through the speed of sound accurately and the U.S. Rifle Model 1903 was manufactured with a ladder sight for shooting up to 2,200 yards.

According to the invention, a 1 in 10.40 inches twist for this rifle/bullet/cartridge combination will result in better accuracy in all three speed realms. If only the supersonic speed realm is being considered a 15.60 inch twist would properly stabilize this bullet.

In 1906 military developments in Europe caused the U.S. to change the 30/03 to a "longer range" cartridge by slightly shortening the case neck and using a pointed boat tailed bullet of the same length shot at a higher velocity. The new bullet designated the M-1 weighed 173 grains and when loaded in the new cartridge case was designated the Caliber 30 Model 1906 hence called the 30/06. This rifle/bullet/cartridge combination had a muzzle velocity of 2,640 feet per second. The U.S. Rifle Model 1903 was modified to the U.S. Rifle Model 1903 A1 with a ladder sight that will elevate to 2,700 yards. By the Greenhill formula this should not require any change in the pitch or twist of the rifling because both bullets are the same diameter and length. The rifling was left at one turn in 10 inches. However, it was soon discovered the new 173 grain bullet with its very high 0.56 ballistic coefficient would not reliably maintain trajectory or accuracy past about 1,100 yards.

According to the invention, this rifle/bullet/cartridge combination requires a 7.86 inch twist to properly stabilize the bullet. The rifle/bullet/cartridge will maintain trajectory through the transonic at an 8.0 twist but additional rotation is required to balance the bullet to its harmonic node for best accuracy. If only the supersonic realm is desired, the twist required should be 11.8 inches per revolution for best accuracy. The 10.0 inches twist with which almost all 30/06 rifles have been manufactured is too slow a twist for accurately shooting the M-1 bullet or its National Match counterpart the M72 in all three speed realms. The 1 turn in 10 inches twist is also too fast for shooting this bullet in the supersonic speed realm. It is for this reason the 30/06 occasionally throws fliers in matches that heretofore were unexplainable. This 173 grain bullet looses about 135 feet per second per 100 yards when supersonic and only looses about 22 feet per second per 100 yards when subsonic. At 3,000 yards it still has adequate velocity (−700 fps) to fully penetrate the intended target. The potential accurate range of this rifle/cartridge/bullet combination was never fulfilled.

The current 7.62×51 mm M118 sniper cartridge shoots a 175 grain Sierra Matchking bullet at about 2,550 feet per second. This bullet has a ballistics coefficient of 0.495 at 2550 fps. The bullet is 1.25 inches in length. The current M24 rifle system using this bullet has a 1 in 11 or 1 in 12 twist. It will not reliably shoot through the transonic and its supersonic range is about 900 yards.

According to the invention, this rifle/bullet/cartridge combination requires an 8.56 inches twist to fully stabilize the bullet. It has been found that with an 8.4 inches rifling twist, this cartridge/bullet/barrel combination will maintain accuracy past 3,000 yards.

Although the derived relationship is a numerical average, the formula calculates the best twist to achieve accurate penetration of the transonic speed realm and the desired rotational harmonics for best overall accuracy within plus or minus 2.5%. Slight adjustments to achieve optimal twist for a given bullet/cartridge/rifle combination can be made based upon actual firing test data. However, the perfect twist will be found within a margin of a few percent points higher or lower than the twist calculated by the invention.

According to a second aspect of the invention, for a rifle having given rifling, a cartridge can be determined from the formula.

According to a third aspect of the invention, a cartridge and rifle are in compliance with the formula.

According to a fourth aspect of the invention, a barrel for a rifle and a bullet it receives are in compliance with the formula.

In general the above formula increases the nominal twist rate above that derived as standard by the Greenhill formula for bullets with a ballistic coefficient above 0.325. Extensive testing and extrapolations of data on various cartridges indicate the new formula's twist rate has little detrimental increase in pressure and should not cause any cartridge to exceed S.A.A.M.I. pressure standards.

Although a particular embodiment of the invention has been illustrated and described, various changes may be made in the form, composition, construction and arrangement of the parts herein without sacrificing any of its advantages. Therefore, it is to be understood that all matter herein is to be interpreted as illustrative and not in any limiting sense, and is intended to cover in the appended claims such modifications as come within the true spirit and scope of the invention.

As an example the components of the formula can be solved backwards. For any known twist and caliber rifle, the correct and stable combined bullet length and ballistic coefficient or bullet weight and profile can be established for best accuracy.

I claim:

1. In combination:

a cartridge having a bullet; the bullet having a diameter, a length, a ballistic coefficient (BC), and a muzzle velocity ($V_1$) greater than 1250 ft/sec; and a rifle including:

a barrel for receiving said bullet including:

rifling having a twist substantially equal to:

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: $V_2$, a transonic reference speed, is 1,250 ft/sec., and $V_3$ is $V_1$ minus $V_2$.

2. The combination of claim 1 wherein:

the BC of said bullet is greater than 0.325.

3. The combination of claim 1 wherein:

the BC of said bullet is greater than 0.400.

4. The combination of claim 1 wherein:

the BC of said bullet is greater than 0.500.

5. A barrel for a rifle for receiving a bullet; the bullet having a diameter, a length, a ballistic coefficient (BC), and a muzzle velocity ($V_1$) greater than 1250 ft/sec; the barrel including:

rifling having a twist substantially equal to:

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: $V_2$, a transonic reference speed, is 1,250 ft/sec., and $V_3$ is $V_1$ minus $V_2$.

6. The combination of claim 5 wherein:

the BC of the bullet is greater than 0.325.

7. The combination of claim 6 wherein:

the BC of the bullet is greater than 0.400.

8. The combination of claim 6 wherein:

the BC of the bullet is greater than 0.500.

9. A method of determining the rifling twist for a rifle barrel; the barrel for receiving a bullet having a diameter, a length, a ballistic coefficient (BC), and a muzzle velocity ($V_1$) greater than 1250 ft/sec; comprising the step of determining the twist as being substantially equal to:

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: $V_2$, a transonic reference speed, is 1,250 ft/sec., and $V_3$ is $V_1$ minus $V_2$.

10. The method of claim 9 wherein:

the BC of the bullet is greater than 0.325.

11. The method of claim 9 wherein:

the BC of said bullet is greater than 0.400.

12. The method of claim 9 wherein:

the BC of said bullet is greater than 0.500.

13. A method of designing a cartridge for a rifle; the rifle having a barrel having a bore having rifling having a twist and defining a caliber; the cartridge having a bullet having a diameter, a length, a ballistic coefficient (BC), and a muzzle velocity ($V_1$) greater than 1250 ft/sec; comprising the step of satisfying:

$$83.7 \div \left(\frac{\text{bullet length} \times \sqrt{2BC}}{\text{bullet diameter}}\right) \times \text{bullet diameter} \times \left[1 + \left(\frac{V_3}{V_1} \times 0.667\right)\right]$$

where: $V_2$, a transonic reference speed, is 1,250 ft/sec., and $V_3$ is $V_1$ minus $V_2$.

14. The method of claim 13 wherein:

the BC of the bullet is greater than 0.325.

15. The method of claim 13 wherein:

the BC of said bullet is greater than 0.400.

16. The method of claim 13 wherein:

the BC of said bullet is greater than 0.500.

* * * * *

UNITED STATES PATENT AND TRADEMARK OFFICE

CERTIFICATE OF CORRECTION

PATENT NO. : 7,802,394 B1
APPLICATION NO. : 11/899647
DATED : September 28, 2010
INVENTOR(S) : Bartoli It is certified that error appears in the above-identified patent and that said Letters Patent is hereby corrected as shown below:

In column 5, line 40 "(-700 fps)" is changed to (~ 700 fps).

In claim 13, after "satisfying:" is inserted --twist substantially equal to--.

Signed and Sealed this
Eleventh Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,802,394 B1
APPLICATION NO. : 11/899647
DATED : September 28, 2010
INVENTOR(S) : Bartoli It is certified that error appears in the above-identified patent and that said Letters Patent is hereby corrected as shown below:

In column 5, line 40 "(-700 fps)" is changed to (~ 700 fps).

In claim 13, column 8, line 4 after "satisfying:" is inserted --twist substantially equal to--.

This certificate supersedes the Certificate of Correction issued January 11, 2011.

Signed and Sealed this
Fifteenth Day of February, 2011

David J. Kappos

David J. Kappos
*Director of the United States Patent and Trademark Office*